US012344453B2

(12) United States Patent
Kim

(10) Patent No.: US 12,344,453 B2
(45) Date of Patent: Jul. 1, 2025

(54) MIXING CONTAINER MADE BY INJECTION MOLDING

(71) Applicant: Yoonwoo Kim, Yongin-si (KR)

(72) Inventor: Yoonwoo Kim, Yongin-si (KR)

(73) Assignee: Moonhwan Kim, Daegu (KR)

( * ) Notice: Subject to any disclaimer, the term of this patent is extended or adjusted under 35 U.S.C. 154(b) by 59 days.

(21) Appl. No.: 18/275,387

(22) PCT Filed: Jan. 31, 2022

(86) PCT No.: PCT/KR2022/001677
§ 371 (c)(1),
(2) Date: Aug. 1, 2023

(87) PCT Pub. No.: WO2022/173162
PCT Pub. Date: Aug. 18, 2022

(65) Prior Publication Data

US 2024/0101333 A1 Mar. 28, 2024

(30) Foreign Application Priority Data

Feb. 13, 2021 (KR) ..... 10-2021-0019564

(51) Int. Cl.
*B65D 81/32* (2006.01)
*B65D 53/02* (2006.01)

(52) U.S. Cl.
CPC ..... *B65D 81/3211* (2013.01); *B65D 53/02* (2013.01)

(58) Field of Classification Search
CPC ..... B65D 81/361; B65D 88/005; B65D 81/3211; B65D 53/02; B65D 81/3205; B65D 25/00–08; B65D 81/3216; B65D 21/083
See application file for complete search history.

(56) References Cited

U.S. PATENT DOCUMENTS 6,116,439 A * 9/2000 Yaniv ..... B65D 11/04 215/11.1
8,028,847 B2 * 10/2011 Klaver ..... A61J 9/00 215/11.1

(Continued)

FOREIGN PATENT DOCUMENTS

JP 2003-200977 A 7/2003
KR 10-2021-0074960 A 6/2021
KR 10-2021-0099359 A 8/2021

*Primary Examiner* — Kareen K Thomas
(74) *Attorney, Agent, or Firm* — PARK LAW FIRM

(57) ABSTRACT

The present invention provides a mixing container manufactured through injection molding, comprising: a material receiving part having an outlet, a receiving space, an open lower side, and a clamp coupling part; a bottle end which covers the open lower side of the material receiving part and has a coupling part formed inside the bottle end, a first sealing film, a sealing means, and a stop means; and a bottle end clamp which is coupled with the clamp coupling part to prevent separation of the bottle end and has a coupling part, and a bottle end separation prevention part. A mixing container can be manufactured by an assembly process alone, thereby simplifying the manufacturing process, and allowing easy disassembly of assembly of components to facilitate recycling thereof and prevent environmental pollution.

20 Claims, 7 Drawing Sheets

(56) References Cited

U.S. PATENT DOCUMENTS

| | | | | |
|---|---|---|---|---|
| 8,146,758 | B1 * | 4/2012 | Peres | A61J 9/008 215/11.1 |
| 9,004,301 | B2 * | 4/2015 | Wahlstrom | A61J 1/2093 215/11.4 |
| 9,289,356 | B2 * | 3/2016 | Farber | A61J 11/008 |
| 11,155,397 | B2 * | 10/2021 | Willis | B29C 45/1676 |
| 2006/0049127 | A1 | 3/2006 | Katz et al. | |
| 2008/0169265 | A1 | 7/2008 | Huang et al. | |

* cited by examiner

MIXING CONTAINER MADE BY INJECTION MOLDING

TECHNICAL FIELD

The present invention relates to a mixing container, and more particularly to a mixing container including a material-containing part, a bottle end, and a bottle end clamp, which is manufactured through injection molding.

BACKGROUND ART

Among various products which are extensively used in recent years, there are products which are intended to obtain a desired effect or a better effect when two or more kinds of components are mixed with each other and products in which two kinds of components are distributed in the state of being contained in respective containers and are mixed with each other just before use.

Examples thereof may include hair dyes for dyeing hair, injectable drugs and distilled water, liquid resins which begin to cure when mixed with a curing agent, drinkable vinegar, alcoholic beverages mixed with green plum concentrated liquid, healthy drinks containing vitamins, cosmetic products, medicines, foodstuffs and the like.

Because the above-mentioned components may immediately metamorphose or cannot be stored for a long period when mixed with each other, it is common that the components are stored and distributed in the state of being isolated from each other and are mixed with each other immediately before use.

Because such products, which are stored and distributed in the state of being isolated from each other, are distributed in the state of being contained in separate containers, there is a disadvantage in that a kind of material contained in a container must be injected into another container containing another kind of material or an additional mixing container must be used.

In order to compensate for the disadvantage, research and development of various solutions, which are intended to enable containers containing different kinds of materials to be coupled to each other so as to be mixed with each other, has been actively conducted.

As an example of the solution, there is Korea Unexamined Patent Publication No. 10-2012-0085539 (referred to hereinafter as "Patent Document 1"), which is proposed by the present applicant.

Patent Document 1 discloses a container equipped with a pair of openings, which are capable of being coupled to each other so as to allow different contents contained therein to be mixed with each other.

However, Patent Document 1 does not disclose a concrete processing method for providing the structure disclosed therein. Here, when the container having the disclosed structure is manufactured through a method such as a cutting process, there are disadvantages in that a great deal of time and effort are required and it is very difficult to apply a blowing process which is extensively used for reduction of production cost.

Furthermore, the container disclosed in Patent Document 1 uses rubber as a material of a membrane configured to seal the container to prevent the contents contained in the container from flowing to the outside. However, the container exhibits a disadvantage in that the membrane is likely to rupture so that the contents flow to the outside during distribution when the container contains, for example, a carbonated drink or beer having high internal pressure.

Accordingly, in order to solve these disadvantages, there is a need to provide a container, which is capable of reducing time and cost required for manufacture, has high pressure resistance, and is capable of being easily coupled to another container so as to allow different contents to be mixed.

The present specification refers to plural research papers and patent documents over the entire range thereof, and the citation thereof is mentioned therein. The cited research papers and patent documents are incorporated in the specification by reference in their entirety in order to more clearly explain the level of the technical field to which the present invention belongs and the contents of the present invention.

DISCLOSURE

Technical Problem

The inventors of the present invention have found that, because a conventional mixing container equipped with a bottle end is constructed such that a material-containing part and the bottle end are attached to each other through a seaming or hot melt process, the manufacturing process becomes complicated or a problem of environmental pollution caused by the hot melt process occurs. Therefore, the inventors have intensively studied in order to solve the problem. As a result, the inventors have found that, when a material-containing part is manufactured through injection molding so as to form a bottle end coupled at the lower side thereof and a bottle end clamp capable of coupling a bottle end to the material-containing part is applied, the manufacturing process becomes simple, and recycling becomes easy, thereby solving the problem of environmental pollution, and thus have achieved the present invention.

Accordingly, an object of the present invention is to provide a mixing container manufactured through injection molding.

It is another object of the present invention to provide a bottle end clamp.

Other objects and advantages of the present invention will be clearly understood from the following detailed description, claims, and the attached drawings.

Technical Solution

The present invention provides a mixing container. The inventors of the present invention have found that, because a conventional mixing container equipped with a bottle end is constructed such that a material-containing part and the bottle end are attached to each other through a seaming or hot melt process, the manufacturing process becomes complicated or a problem of environmental pollution caused by the hot melt process occurs. Therefore, the inventors have intensively studied in order to solve the problem. As a result, the inventors have found that, when a material-containing part is manufactured through injection molding so as to form a bottle end coupled at the lower side thereof and a bottle end clamp capable of coupling a bottle end to the material-containing part is applied, the manufacturing process becomes simple, and recycling becomes easy, thereby solving the problem of environmental pollution, and thus have achieved the present invention.

In accordance with an aspect of the present invention, the present invention provides a mixing container including a material-containing part, which comprises an outlet formed at an upper side thereof and a receiving space formed therein and which is open at a lower side thereof and includes a clamp coupler formed on an outer peripheral surface of a lower portion thereof, a bottle end, which covers the open lower side of the material-containing part and has formed therein an outlet coupler configured to be coupled to the outlet or an outlet of another container and which includes a first sealing membrane formed at an upper side thereof and a sealing unit formed on an outer peripheral surface thereof to seal material contained in the material-containing part, and a bottle end clamp, which is coupled to the clamp coupler to prevent separation of the bottle end and which includes a material-containing part coupler formed on an inner peripheral surface thereof and a bottle end clamp formed at a lower side thereof.

The term "bottle end" used herein may mean any means for sealing an open lower side of the material-containing part.

The term "bottle end clamp" used herein may mean any means for preventing separation of the bottle end coupled to the material-containing part.

The term "injection molding" used herein may mean any molding process of injecting molten raw material into a mold to form a product.

In accordance with a preferred aspect of the present invention, the mixing container according to the present invention is preferably constructed such that the outlet coupler is coupled to an outlet of another container and then the first sealing membrane is opened so as to allow the materials contained in both the containers to be mixed with each other.

In accordance with a preferred aspect of the present invention, the mixing container according to the present invention may further include a stopper formed at lower side on the outer peripheral surface of the bottle end.

The further formation of the stopper on the outer peripheral surface of the bottle end according to the present invention is a critical construction. The reason for this is because it is possible to prevent the bottle end from being pushed into the material-containing part during an assembly procedure when the stopper is further formed at the lower side of the outer peripheral surface of the bottle end.

In accordance with a preferred aspect of the present invention, the material-containing part according to the present invention is preferably manufactured through an injection molding process.

The manufacture of the material-containing part through an injection molding process according to the present invention is a critical construction. The reason for this is because it is possible to provide the lower side of the material-containing part with the coupler capable of being coupled to the bottle end or the clamp and thus to manufacture the mixing container only through an assembly process when the material-containing part is manufactured through an injection molding process.

In accordance with a preferred aspect of the present invention, the clamp according to the present invention may include a second sealing membrane at a lower side thereof to prevent contamination of the bottle end.

The provision of the second sealing membrane to the lower side of the clamp according to the present invention is a critical construction. The reason for this is because it is possible to prevent contamination of the bottle end as well as to omit an additional process of attaching an additional sealing membrane to the clamp when the second sealing membrane is provided at the lower side of the clamp to prevent contamination of the bottle end.

In accordance with a preferred aspect of the present invention, the second sealing membrane according to the present invention preferably includes a sealing membrane remover formed thereat or coupled thereto to remove the sealing membrane.

In accordance with a preferred aspect of the present invention, the mixing container according to the present invention preferably further includes a cap coupled to the outlet.

In accordance with a preferred aspect of the present invention, the material-containing part, the bottle end and the bottle clamp according to the present invention may be made of a single material.

In accordance with a preferred embodiment of the present invention, the single material according to the present invention is preferably selected from the group consisting of PET, PE and PP, is more preferably PET or PE, and is most preferably PE.

In accordance with a preferred aspect of the present invention, preferably, the bottle end according to the present invention includes a bottle end upper portion, a bottle end lateral portion, an open lower portion, and the outlet coupler, the first sealing membrane is formed at a center of an upper portion of the bottle end, the sealing unit is formed at the bottle end lateral portion, and the outlet coupler extends toward the open lower portion from a lower surface of the bottle end upper portion.

In accordance with a preferred embodiment of the present invention, the outlet coupler according to the present is preferably provided therein with an outlet coupling unit.

In accordance with a preferred embodiment of the present invention, a space is preferably defined between the bottle end lateral portion and the outlet coupler, according to the present invention.

The formation of space between the bottle end lateral portion and the outlet coupler according to the present invention is a critical construction. The reason for this is because it is possible to reduce weight of the molded product and thus production cost as well as to prevent a shrinkage phenomenon which would otherwise occur due to difference in thickness during the injection molding process.

In accordance with another aspect of the present invention, the present invention provides a bottle end included in a mixing container including a material-containing part, which includes an outlet formed at an upper side thereof and a receiving space formed therein and which is open at a lower side thereof; and the bottle end, which covers the open lower side of the material-containing part and has formed therein an outlet coupler configured to be coupled to the outlet or an outlet of another container and which includes a first sealing membrane formed at an upper side thereof and a sealing unit formed on an outer peripheral surface thereof, wherein the bottle end includes a bottle end upper portion, a bottle end lateral portion, an open lower portion, and the outlet coupler, the first sealing membrane is formed at a center of an upper portion of the bottle end, the sealing unit is formed at the bottle end lateral portion, and the outlet coupler extends toward the open lower portion from a lower surface of the bottle end upper portion.

In accordance with a further aspect of the present invention, the present invention provides a bottle end clamp included in a mixing container including a material-containing part, which includes an outlet formed at an upper side thereof and a receiving space formed therein and which is open at a lower side thereof and includes a clamp coupler formed on an outer peripheral surface of a lower portion thereof, a bottle end, which covers the open lower side of the material-containing part and has formed therein an outlet coupler configured to be coupled to the outlet or an outlet of another container and which includes a first sealing membrane formed at an upper side thereof and a sealing unit formed on an outer peripheral surface thereof, and a bottle end including a stopper at a lower side thereof, in order to prevent separation of the bottle end, wherein the bottle end clamp is coupled to the clamp coupler to prevent separation of the bottle end and includes a material-containing part coupler formed on an inner peripheral surface thereof and a bottle end holder formed at a lower side thereof.

Advantageous Effects

Characteristics and advantages of the present invention may be summarized as follows.

(a) The present invention provides a mixing container manufactured through injection molding, including a material-containing part, which includes an outlet formed at an upper side thereof and a receiving space formed therein and which is open at a lower side thereof and includes a clamp coupler formed on an outer peripheral surface of a lower portion thereof, a bottle end, which covers the open lower side of the material-containing part and has formed therein an outlet coupler configured to be coupled to the outlet or an outlet of another container and which includes a first sealing membrane formed at an upper side thereof, a sealing unit formed on an outer peripheral surface thereof to seal material contained in the material-containing part and a stopper and a stopper formed at a lower side thereof, and a bottle end clamp, which is coupled to the clamp coupler to prevent separation of the bottle end and which includes a material-containing part coupler formed on an inner peripheral surface thereof and a bottle end clamp formed at a lower side thereof.

(b) Since the mixing container according to the present invention is manufactured only through assembly process, a manufacturing process is simple, and assembled components are easily separated, thereby facilitating recycle the components and thus solving a problem of environmental pollution.

BEST MODE

Figure 1:
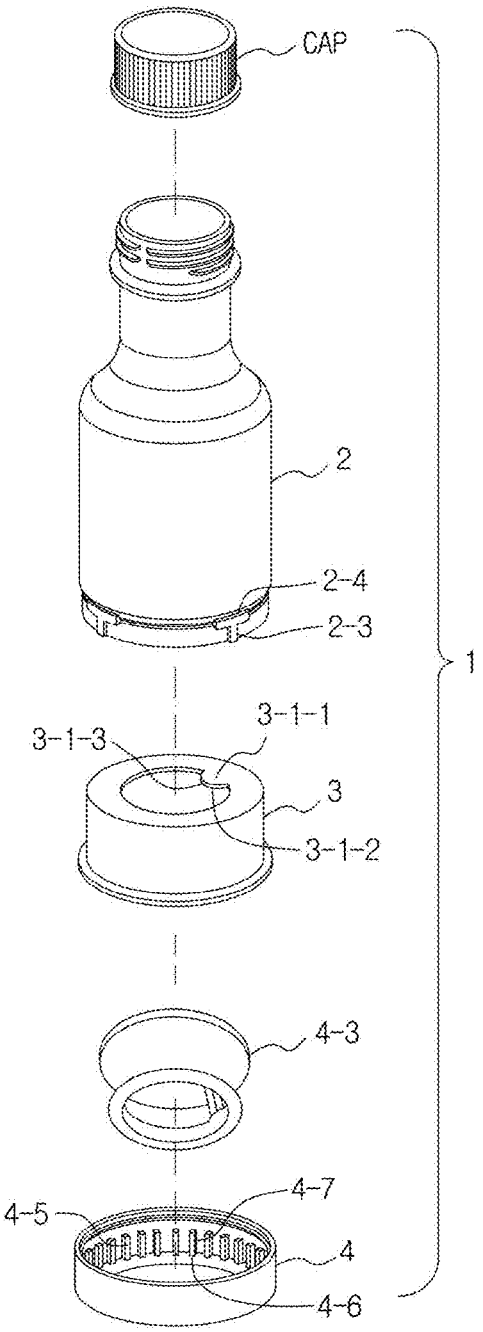
FIG. 1 is an assembly view of the mixing container according to the present invention.

Although the present invention can be variously modified in many different forms, specific embodiments of the present invention will be illustrated in the drawings and be described with reference to the drawings. However, it is to be understood that the following description is not intended to limit the present invention to those exemplary embodiments and that the present invention is intended to cover various modifications, equivalents, and alternatives, which may be included within the spirit and scope of the present invention. In the following description of the present invention, if it is decided that a detailed description of known functions or configurations related to the invention would make the subject matter of the invention unclear, such detailed description is omitted.

Hereinafter, embodiments of the present invention will be described in detail with reference to the accompanying drawings.

Figure 2:
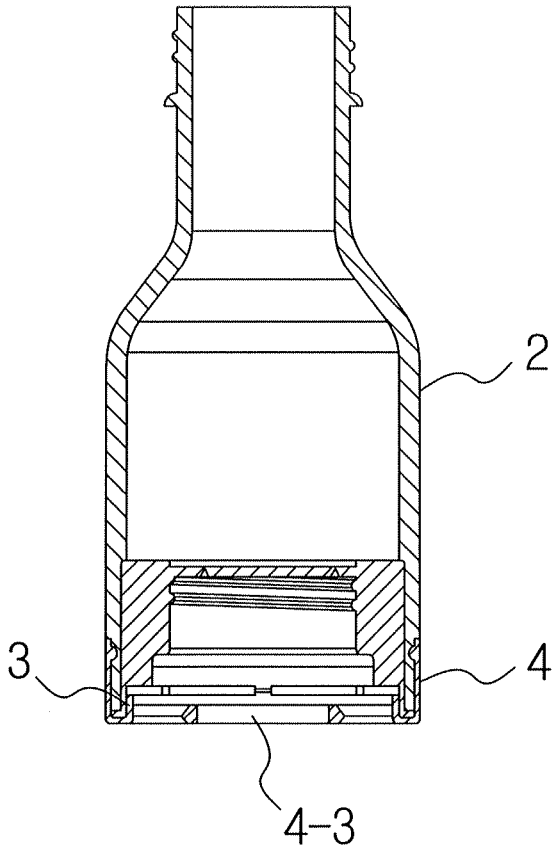
FIG. 2 is a cross-sectional view of the mixing container according to the present invention.
Figure 3:
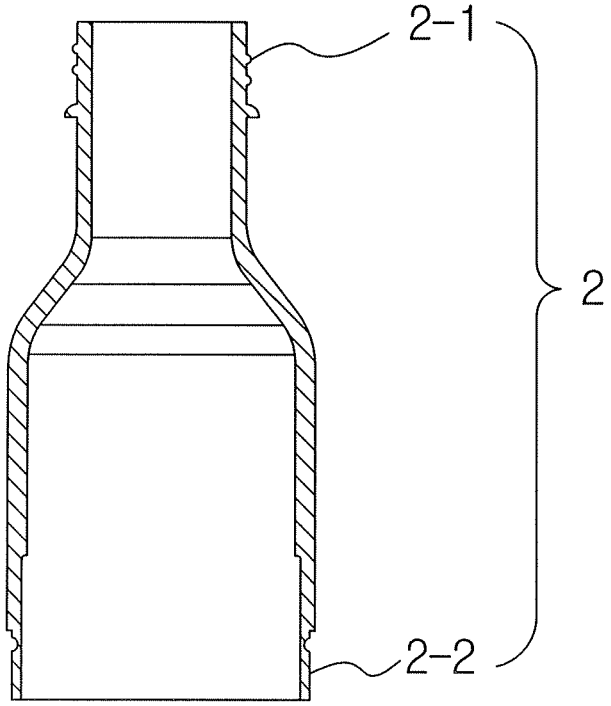
FIG. 3 is a cross-sectional view of a material-containing part of the mixing container according to the present invention.
Figure 6:
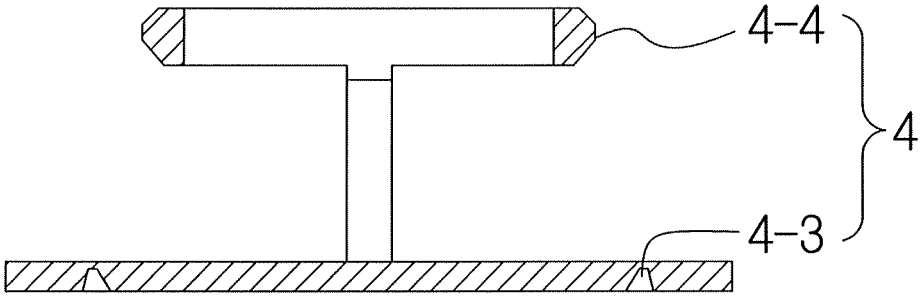
FIG. 6 is a cross-sectional view of a second sealing membrane of the mixing container according to the present invention.
Figure 7:
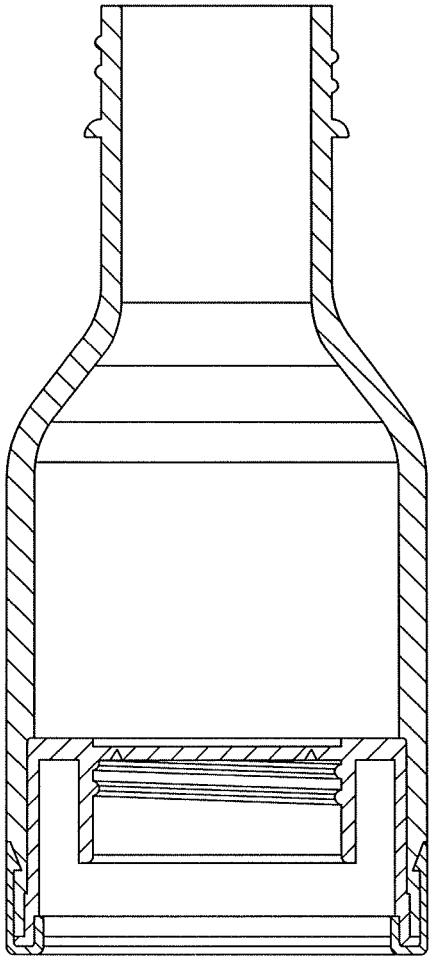
FIG. 7 is a cross-sectional view of the mixing container according to the present invention.

FIGS. 1, 2 and 7 illustrate an assembly view and cross-sectional views of the mixing container 1 according to an embodiment of the present invention, which is manufactured through injection molding. FIGS. 3 to 6 illustrate cross-sectional views of a material-containing part, a bottle end, a bottle end clamp, and a second sealing membrane of the mixing container 1 according to an embodiment of the present invention, which is manufactured through injection molding.

Referring to FIGS. 1 to 7, the mixing container 1 according to an embodiment of the present invention, which is manufactured through injection molding, includes a material-containing part 2, which includes an outlet 2-1 and a clamp coupler 2-2, a bottle end 3, which includes a bottle end upper portion 3-1, a first sealing membrane 3-1-1, a bottle end-lateral portion 3-2, a sealing unit 3-2-1, an open lower portion 3-3, an outlet coupler 3-4, an outlet coupling portion 3-4-1, and a space 3-5, and a bottle end clamp 4, which includes a material-containing part coupler 4-1, a bottle end holder 4-2, a second sealing membrane 4-3, and a sealing membrane remover 4-4.

The mixing container 1 according to an embodiment of the present invention, which is manufactured through injection molding, is constructed by assembling the material-containing part 2 with the bottle end clamp 4. As illustrated in FIGS. 1 to 7, the mixing container is constructed in such a way that the outer surface of the clamp coupler 2-2 is fitted into the inner surface of the material-containing part coupler 4-1 so as to be brought into close contact with each other.

Referring to FIGS. 1 and 2, the material-containing part 2 according to an embodiment of the present invention includes the outlet 2-1, the clamp coupler 2-2, and a cap. The clamp coupler 2-2 has one or more fingerlike protrusions 2-3 and the bottle end clamp 4 has a plurality of ridges 4-5, wherein each ridge 4-5 has a horizontal side 4-6 and a vertical side 4-7 wherein the vertical side 4-7 is longer in length than the horizontal side 4-6, and wherein the fingerlike protrusion 2-3 of the clamp coupler 2-2 fits between two ridges 4-5 along the vertical sides 4-7 of the ridges 4-5. The clamp coupler 2-2 also has one or more horizontal protrusions 2-4 attached perpendicular to one or more fingerlike protrusions 2-3 so that the horizontal protrusion 2-3 rests on two or more ridges 4-5.

The material-containing part 2 is provided at the upper portion thereof with the outlet 2-1 capable of being coupled to the cap, and is provided at the lower portion thereof with the clamp coupler 2-2.

The clamp coupler 2-2 is positioned at the lower portion of the material-containing part 20, and is provided on the outer surface thereof with a shaped portion capable of being coupled to the material-containing part coupler 4-1.

Figure 4:
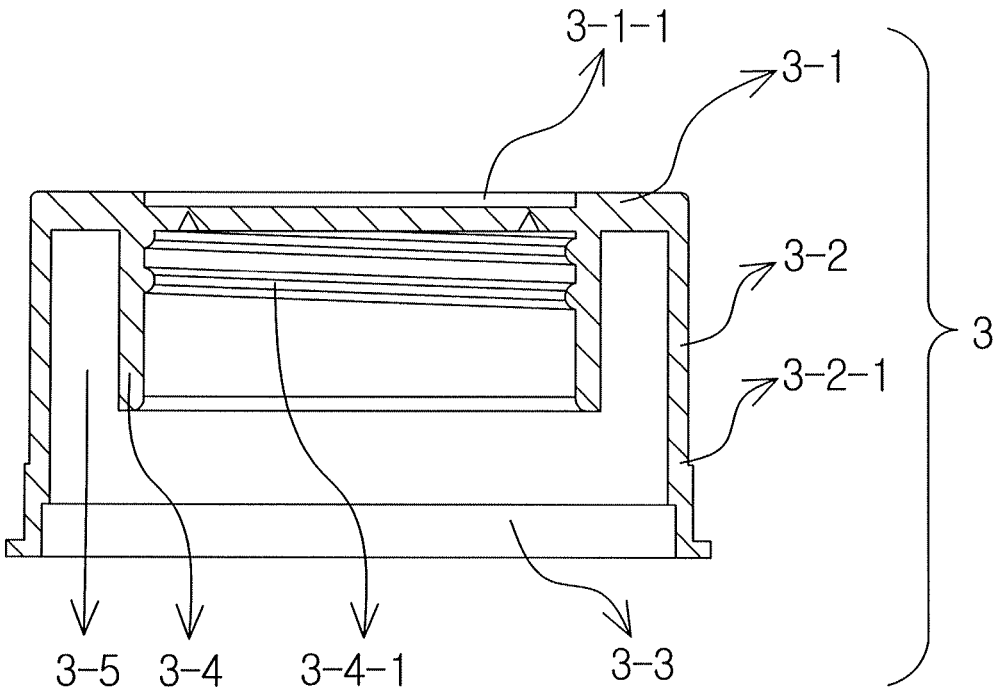
FIG. 4 is a cross-sectional view of a bottle end of the mixing container according to the present invention.

Referring to FIGS. 1 and 4, the bottle end 3 of the mixing container 1 according to an embodiment of the present invention, which is manufactured through injection molding, includes the bottle end upper portion 3-1, the first sealing membrane 3-1-1, the bottle end lateral portion 3-2, the sealing unit 3-2-1, the open lower portion 3-3, the outlet coupler 3-4, an outlet coupling unit 3-4-1, and the space 3-5.

The first sealing membrane 3-1-1 is positioned at the bottle end upper portion 3-1, and the first sealing protrusion 3-1-2 is semi-circle shaped (in the shape of a semi-circle 3-1-3). When the outlet of another mixing container is coupled to the outlet coupler 3-4, the first sealing membrane 3-1-1 is ruptured such that the material contained in the other container is mixed with the material contained in the material-containing part 2.

The sealing unit 3-2-1 may be positioned at the bottle end lateral portion 3-2 in order to prevent the material contained in the material-containing part 2 from leaking.

The outlet coupler 3-4 extends toward the open lower portion 3-3 from the lower surface of the bottle end upper portion 3-1, and the outlet coupler 3-4 is provided on the inner peripheral surface thereof with the outlet coupling unit 3-4-1.

The space 3-5 is positioned between the bottle end lateral portion 3-2 and the outlet coupler 3-4. When a certain space is defined between the bottle end lateral portion 3-2 and the outlet coupler 3-4, it is possible to reduce the injection weight of the outlet end as well as to maintain the thickness of injection molding constant, thereby preventing a twisting phenomenon which would otherwise occur due to difference in thickness in an injection molding operation.

Figure 5:
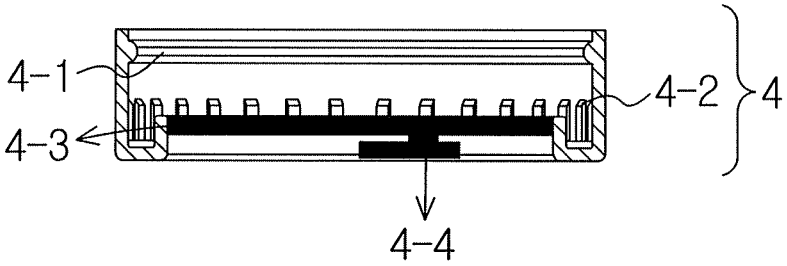
FIG. 5 is a cross-sectional view a bottle end clamp of the mixing container according to the present invention.

Referring to FIGS. 1, 5 and 6, the bottle end clamp 4 of the mixing container 1 according to an embodiment of the present invention, which is manufactured through injection molding, the material-containing part coupler 4-1, the bottle end holder 4-2, the second sealing membrane 4-3, and the sealing membrane remover 4-4.

The material-containing part coupler 4-1 is positioned at the inner side of the upper portion of the bottle end clamp 4, and is coupled to the clamp coupler 2-2 positioned at the lower portion of the material-containing part 2.

The bottle end holder 4-2 is positioned at the inner side of the lower portion of the bottle end clamp 4, and holds the lower end of the bottle end 3 to prevent the bottle end 3 from being separated from the material-containing part 2.

The bottle end holder 4-2 is positioned inside the bottle end clamp 4, and serves to hold the second sealing membrane 4-3 and to receive an external material therein.

Referring to FIG. 6, the second sealing membrane 4-3 may be formed at the lower end of the bottle end clamp 4.

Here, the second sealing membrane 4-3 may be integrally molded with the bottle end clamp 4.

The sealing membrane remover 4-4 is positioned at the lower side of the second sealing membrane 4-3, and is used to remove the second sealing membrane 4-3 by pulling the same. Although not illustrated in the drawings, a perforated line may be formed at the boundary of the second sealing membrane 4-3 for removal of the second sealing membrane 4-3.

The perforated line is positioned at the boundary of the second sealing membrane 4-3 so as to help to remove the second sealing membrane 4-3 using external force.

INDUSTRIAL APPLICABILITY

The present invention relates to a mixing container manufactured through injection molding, and more particularly to a mixing container manufactured through injection molding, which includes a material-containing part, a bottle end, and a bottle-end clamp and is applicable to industry.

The invention claimed is:

1. A mixing container comprising:

a material-containing part, which comprises an outlet formed at an upper side thereof and a receiving space formed therein and which is open at a lower side thereof and comprises a clamp coupler formed on an outer peripheral surface of a lower portion thereof;

a bottle end, which covers the open lower side of the material-containing part and has formed therein an outlet coupler configured to be coupled to the outlet or an outlet of another container and which comprises a first sealing membrane formed at an upper side thereof and a sealing unit formed on an outer peripheral surface thereof to seal material contained in the material-containing part;

a bottle end clamp, which is coupled to the clamp coupler to prevent separation of the bottle end and which comprises a material-containing part coupler formed on an inner peripheral surface thereof and a bottle end clamp formed at a lower side thereof; and the clamp coupler has one or more fingerlike protrusions and the bottle end clamp has a plurality of ridges, wherein each ridge has a horizontal side and a vertical side wherein the vertical side is longer in length than the horizontal side, and wherein the fingerlike protrusion of the clamp coupler fits between two ridges along the vertical sides of the ridges.

2. The mixing container according to claim 1, wherein the mixing container is constructed such that the outlet coupled is coupled to an outlet of another container and the first sealing membrane is opened so as to allow the material contained in the mixing container to be mixed with material contained in the another container.

3. The mixing container according to claim 1, further comprises a stopper formed at lower side on the outer peripheral surface of the bottle end.

4. The mixing container according to claim 1, wherein the clamp comprises a second sealing membrane at a lower side thereof to prevent contamination of the bottle end.

5. The mixing container according to claim 4, wherein the second sealing membrane comprises a sealing membrane remover formed thereat or coupled thereto to remove the sealing membrane.

6. The mixing container according to claim 1, wherein: the bottle end comprises a bottle end upper portion, a bottle end lateral portion, an open lower portion, and the outlet coupler; the first sealing membrane is formed at a center of an upper portion of the bottle end; the sealing unit is formed at the bottle end lateral portion; and the outlet coupler extends toward the open lower portion from a lower surface of the bottle end upper portion.

7. The mixing container according to claim 6, wherein the outlet coupler is provided therein with an outlet coupling unit.

8. The mixing container according to claim 7, wherein a space is defined between the bottle end lateral portion and the outlet coupler.

9. A bottle end clamp according to claim 1 wherein the first sealing membrane has a first sealing protrusion that is semi-circle shaped.

10. A bottle end clamp according to claim 1 wherein the clamp coupler also has a horizontal protrusion attached perpendicular to one or more fingerlike protrusions so that the horizontal protrusion rests on two or more ridges.

11. The mixing container according to claim 10, wherein the mixing container is constructed such that the outlet coupled is coupled to an outlet of another container and the first sealing membrane is opened so as to allow the material contained in the mixing container to be mixed with material contained in the another container.

12. The mixing container according to claim 10, further comprises a stopper formed at lower side on the outer peripheral surface of the bottle end.

13. The mixing container according to claim 10, wherein the clamp comprises a second sealing membrane at a lower side thereof to prevent contamination of the bottle end.

14. The mixing container according to claim 12, wherein the second sealing membrane comprises a sealing membrane remover formed thereat or coupled thereto to remove the sealing membrane.

15. The mixing container according to claim 10, wherein: the bottle end comprises a bottle end upper portion, a bottle end lateral portion, an open lower portion, and the outlet coupler; the first sealing membrane is formed at a center of an upper portion of the bottle end; the sealing unit is formed at the bottle end lateral portion; and the outlet coupler extends toward the open lower portion from a lower surface of the bottle end upper portion.

16. The mixing container according to claim 14, wherein the outlet coupler is provided therein with an outlet coupling unit.

17. The mixing container according to claim 15, wherein a space is defined between the bottle end lateral portion and the outlet coupler.

18. A bottle end included in a mixing container comprising a material-containing part, which comprises an outlet formed at an upper side thereof and a receiving space formed therein and which is open at a lower side thereof; and the bottle end, which covers the open lower side of the material-containing part and has formed therein an outlet coupler configured to be coupled to the outlet or an outlet of another container and which comprises a first sealing membrane formed at an upper side thereof and a sealing unit formed on an outer peripheral surface thereof, wherein:

the bottle end comprises a bottle end upper portion, a bottle end lateral portion, an open lower portion, and the outlet coupler; the first sealing membrane is formed at a center of an upper portion of the bottle end; the sealing unit is formed at the bottle end lateral portion; and the outlet coupler extends toward the open lower portion from a lower surface of the bottle end upper portion; and the bottle end also having a clamp coupler that has one or more fingerlike protrusions.

19. A bottle end clamp included in a mixing container comprising a material-containing part, which comprises an outlet formed at an upper side thereof and a receiving space formed therein and which is open at a lower side thereof and comprises a clamp coupler formed on an outer peripheral surface of a lower portion thereof; a bottle end, which covers the open lower side of the material-containing part and has formed therein an outlet coupler configured to be coupled to the outlet or an outlet of another container and which comprises a first sealing membrane formed at an upper side thereof and a sealing unit formed on an outer peripheral surface thereof; and a bottle end comprising a stopper at a lower side thereof, in order to prevent separation of the bottle end, wherein the first sealing membrane has a first sealing protrusion, and wherein the bottle end clamp is coupled to the clamp coupler to prevent separation of the bottle end and comprises a material-containing part coupler formed on an inner peripheral surface thereof and a bottle end holder formed at a lower side thereof.

20. A bottle end clamp according to claim 19 wherein the first sealing protrusion is semi-circle shaped.

* * * * *